US006515637B1

(12) United States Patent
Chang

(10) Patent No.: US 6,515,637 B1
(45) Date of Patent: Feb. 4, 2003

(54) ANTENNA FOR PORTABLE WIRELESS COMMUNICATIONS SYSTEM AND A METHOD FOR MANUFACTURING THE SAME

(76) Inventor: Eung-Soon Chang, 103-904 Samik Ceramic Apt. 1038 Mansoo-dong, Namdong-gu, Inchon-si 405-240 (KR)

( * ) Notice: Subject to any disclaimer, the term of this patent is extended or adjusted under 35 U.S.C. 154(b) by 0 days.

(21) Appl. No.: 09/868,204

(22) PCT Filed: May 17, 1999

(86) PCT No.: PCT/KR99/00248

§ 371 (c)(1),
(2), (4) Date: Jun. 14, 2001

(87) PCT Pub. No.: WO00/39882

PCT Pub. Date: Jul. 6, 2000

(30) Foreign Application Priority Data

Dec. 24, 1998 (KR) ..... 98/58549

(51) Int. Cl.[7] ..... H01Q 1/36
(52) U.S. Cl. ..... 343/895; 343/702; 343/901
(58) Field of Search ..... 343/702, 895, 343/900, 901, 893

(56) References Cited

U.S. PATENT DOCUMENTS

| | | | | |
|---|---|---|---|---|
| 4,442,438 A | * | 4/1984 | Siwiak et al. | 343/792 |
| 5,650,789 A | | 7/1997 | Elliott et al. | 343/702 |
| 5,861,859 A | * | 1/1999 | Kanayama et al. | 343/895 |

FOREIGN PATENT DOCUMENTS

| | | |
|---|---|---|
| EP | 0419900 A1 | 4/1991 |
| WO | WO 98 56072 | 12/1998 |

* cited by examiner

*Primary Examiner*—Don Wong
*Assistant Examiner*—Shih-Chao Chen
(74) *Attorney, Agent, or Firm*—R. Neil Sudol; Henry D. Coleman; William J. Sapone

(57) ABSTRACT

The present invention relates to an antenna for a mobile communication system in which the construction of a spring of a helical antenna is improved, and a bandwidth of a high frequency is increased, and an assembling process of the antenna is improved. In the antenna, a spring of the helical antenna is formed in such a manner that a wire having a certain diameter is pressed for thereby forming a plate shaped wire having a certain width, and the plate shaped wire having a certain width is wound by a certain number of tums.

9 Claims, 20 Drawing Sheets

ANTENNA FOR PORTABLE WIRELESS COMMUNICATIONS SYSTEM AND A METHOD FOR MANUFACTURING THE SAME

BACKGROUND OF THE INVENTION

1. Technical Field

The present invention relates to an antenna for a mobile communication system and a fabrication method thereof, and in particular to an antenna for a mobile communication system and a fabrication method thereof which are capable of enhancing a band width of a high frequency signal and simplifying an assembling process of an antenna by improving the structure of a helical antenna in a mobile communication system.

2. Background Art

Generally, an antenna is used for performing a wireless communication. Namely, a high frequency signal is applied from a modulator to an antenna, and a high frequency signal transmitted in the air is received through the antenna.

In order to enhance a transmission and receiving characteristic of an antenna, an impedance of an antenna and an impedance of a transceiver are matched in accordance with a high frequency signal which is transmitted and received for thereby preventing unnecessary emission and loss.

In addition, the antenna used for the mobile communication system is formed of a helical antenna and a rod antenna in an integrated construction. In the case that the rod antenna is received, the helical antenna is operated. In the case that the rod antenna is extracted, the rod antenna and helical antenna are engaged in parallel. The entire operation of the antenna is performed by the rod antenna.

In the above described antenna structure, the helical antenna includes a spring formed by winding a wire.

FIG. 1 is a view illustrating an antenna installed in a conventional wireless communication system. Here, reference numeral 10 represents a body of a mobile communication system, and 20 represents an antenna unit installed in the body 10 for transmitting and receiving a high frequency signal therethrough.

The antenna unit 20 includes a knob 21 by which the antenna is extracted and retracted by holding the same, an insulation portion 22, a helical antenna 23 having a spring 25 which is operated when the antenna engaged to the body 10 of the mobile communication system is received, and a Ni—Ti wire 24 engaged in parallel with the helical antenna 23 when extracting the antenna and functioning as a rod antenna.

FIG. 2 is a view illustrating a helical antenna 23 in the antenna of FIG. 1. As shown therein, the helical antenna 23 includes a spring 25 formed of a wire having a circular cross section and diameter, and a metal rod 26 engaged with the spring 25, so that the lower portion of the spring 25 is wound onto the metal rod 26 by one turn.

In the conventional antenna, since the return loss which occurs when a high frequency signal is transmitted is about 7.5 dB, and the band width a coverage in the antenna is small, the communication quality is decreased in the case that the antenna is touched by a hand of a human, and there is a certain variation in the frequency at the time of communication. In addition, the conventional antenna has about 23.0Ω impedance which is lower than 50Ω of a reference value for thereby causing a mismatching. In addition, in the conventional art, the standing wave ratio is about 2.3 larger than the reference value 1, so that the power return ratio is about 15.5%. Therefore, the power loss of the antenna is increased.

DISCLOSURE OF THE INVENTION

Accordingly, it is an object of the present invention to provide an antenna for a mobile communication system and a fabrication method thereof which are capable of obtaining a lower return loss by improving the structure of a spring installed in a helical antenna, improving a communication quality even when an antenna is touched by a hand of a human or there is a certain variation in the frequency at the time of communication.

In order to achieve the above objects, there is provided an antenna for a mobile communication system which includes a spring of the helical antenna formed in such a manner that a wire having a certain diameter is pressed for thereby forming a plate shaped wire having a certain width, and the plate shaped wire having a certain width is wound by a certain number of turns.

In order to achieve the above objects, there is provided a fabrication method of an antenna for a mobile communication system which includes a first step for pressing a wire having a certain diameter, forming a plate shaped wire having a certain width, winding the plate shaped wire having a certain width by a certain number of turns and forming a spring of a helical antenna, a second step for inserting and soldering an upper end of a metal rod to a lower portion of the spring formed of a plate shaped wire and fixing the same, a third step for insert-molding a pipe in such a manner that a certain space is formed in the center portion in the spring and metal rod fixed in the second step and inserting a bobbin of the pipe, and a fourth step for inserting a + cutting portion to a lower portion of the metal rod and inserting the rod antenna in the space portion of the center portion.

BRIEF DESCRIPTION OF THE DRAWINGS

The present invention will become better understood with reference to the accompanying drawings which are given only by way of illustration and thus are not limitative of the present invention, wherein:

FIGS. 7 through 10 are graphs of a first test result obtained by measuring a characteristic of a helical antenna in such a manner that an antenna according to the present invention and a conventional antenna are not engaged to a body of a mobile communication system, in which:

FIG. 7 is a graph of a return loss characteristic;

FIG. 8 is a Smith chart graph of an impedance;

FIG. 9 is a graph of a standing wave ratio; and

FIG. 10 is a graph of an emission pattern at a 900 MHz high frequency; and

FIGS. 11 through 15 are graphs of a second test result obtained in such a manner that an antenna according to the present invention and a conventional antenna are installed in a body of a mobile communication system, the body of the mobile communication system is not held by a user's hand, and the mobile communication system is placed at a portion above 30 cm from the ground, in which:

FIG. 11 is a graph of a return loss;

FIG. 12 is a Smith chart graph of an impedance;

FIG. 13 is a graph of a standing wave ratio; and

FIGS. 14 and 15 are graphs formed by measuring an emission pattern at 836 MHZ and 881 MHz, respectively; and FIGS. 16 through 20 are graphs of a third test result obtained in such a manner that an antenna according to the present invention and a conventional antenna are installed in a body of a mobile communication system, a rod antenna is extracted, the body of the mobile communication system is not held by a user's hand, and a mobile communication system is placed at a portion above about 30 cm high from the ground in a vertical direction, in which:

FIG. 16 is a graph of a return loss characteristic;

FIG. 17 is a Smith chart graph of an impedance;

FIG. 18 is a view illustrating a standing wave ratio; and

FIGS. 19 and 20 are graphs obtained by measuring an emission pattern at 836 MHz and 881 MHz, respectively.

FIGS. 26 through 30 are graphs of a fifth test result obtained in such a manner that an antenna is engaged to a body of a mobile communication system, a rod antenna is extracted, and the body of a mobile communication system is moved near a right ear of a human, in which:

FIG. 26 is a graph of a return loss characteristic;

FIG. 27 is a graph of a Smith chart of an impedance; and

FIG. 28 is a graph of a standing wave ratio; and

FIGS. 29 and 30 are graphs of emission patterns at 836 MHz and 881 MHz in such a manner that an antenna is engaged to a body of a mobile communication system, a rod antenna is extracted, the body of the mobile communication system is moved near a right ear of a test doll formed in the same shape as a head of a human.

MODES FOR CARRYING OUT THE PREFERRED EMBODIMENTS

The embodiments of the present invention will be explained with reference to FIGS. 3 through 30.

Figure 1:
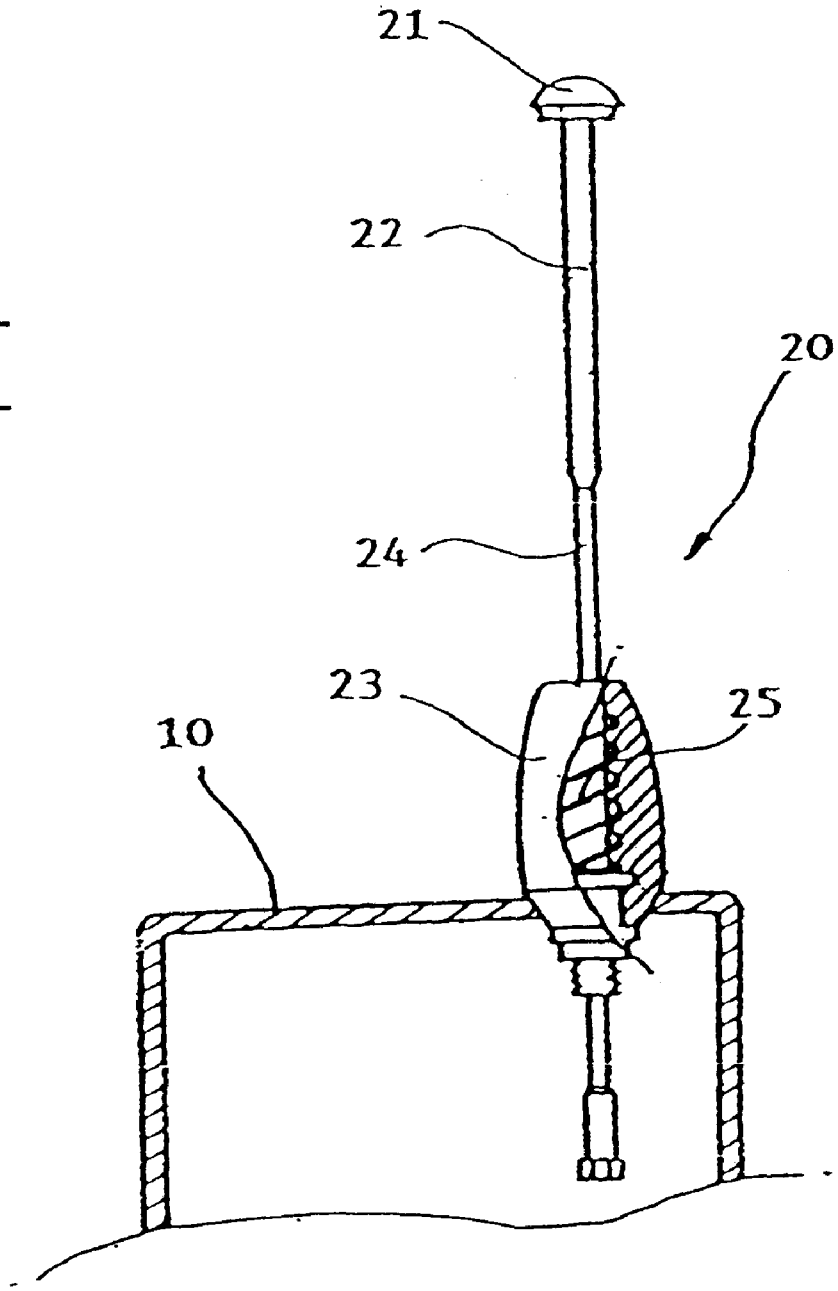
Fig. 1 PRIOR ART
FIG. 1 is a view illustrating an antenna installed in a conventional mobile communication system.
Figure 2:
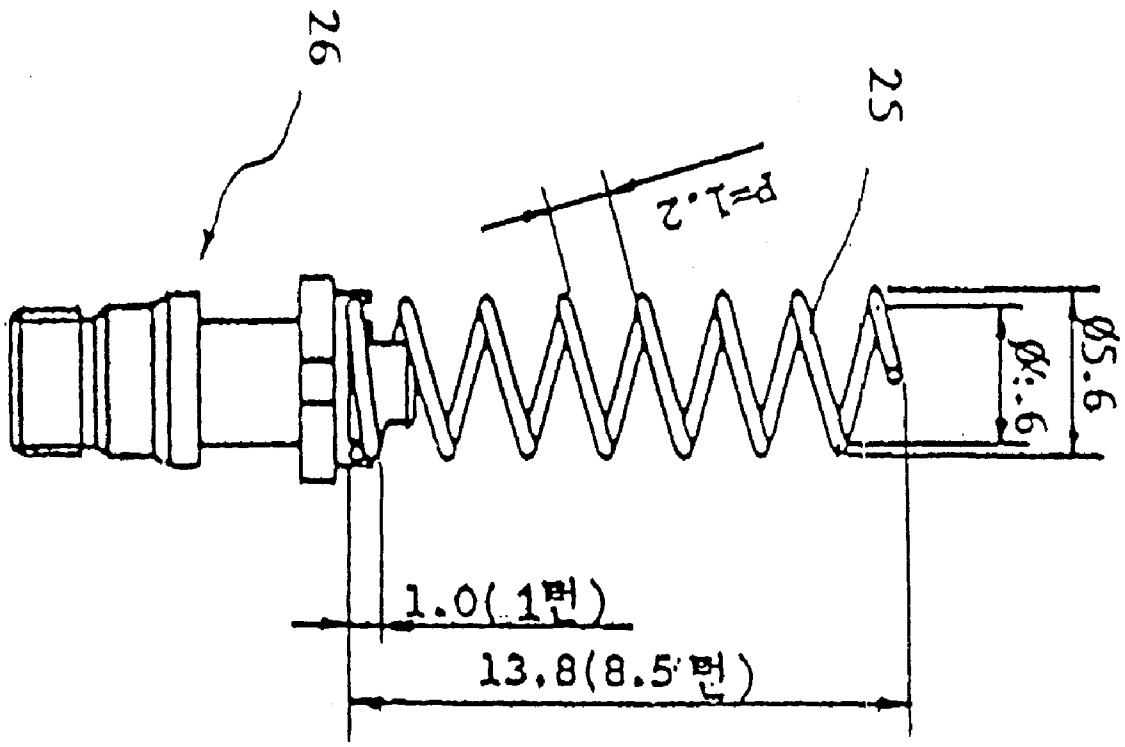
Fig. 2 PRIOR ART
FIG. 2 is a view illustrating a helical antenna in the conventional art.
Figure 3:
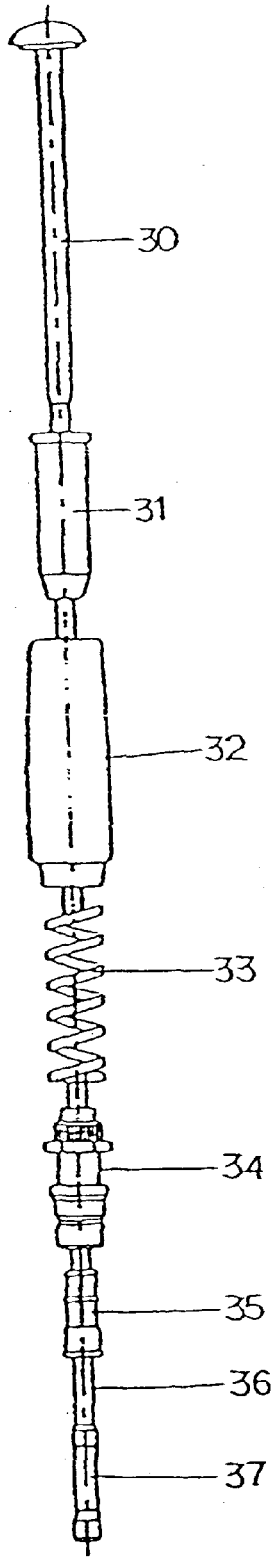
FIG. 3 is a disassembled view illustrating an antenna according to the present invention.

FIG. 3 is a disassembled view illustrating an antenna according to the present invention. As shown therein, a top portion 30 formed of a knob and an insulation portion is formed in the upper portion of the antenna. A bobbin 31 is installed at the lower portion of the top portion 30. A pipe 32 which is formed based on an insert injection method is installed below the bobbin 31. A spring 33 formed by pressing a wire having a diameter of ϕ0.7 for thereby forming a plate shaped wire having a certain width and wound by a certain number of turns is fixed to the metal rod 34. A + cutting portion 35 is formed below the metal rod 34, and a stopper 37 is installed through the Ni—Ti wire 36.

Figure 4:
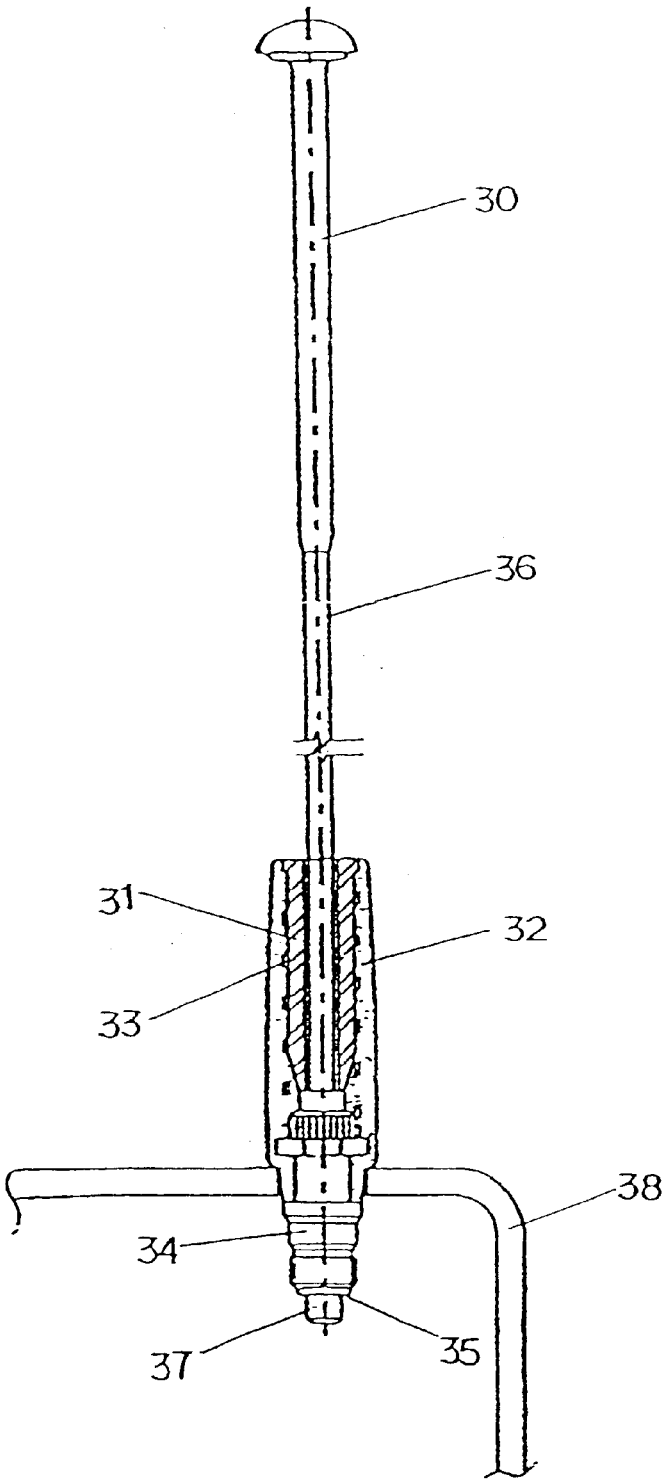
FIG. 4 is an enlarged vertical cross-sectional view illustrating a state that an antenna is assembled according to the present invention.

FIG. 4 is an enlarged vertical cross-sectional view illustrating a state that the antenna is assembled according to the present invention. As shown therein, the rod antenna and the helical antenna are fixed to the body 38. The rod antenna is formed of the top portion 30, the Ni—Ti wire 36 and the stopper 37, and the helical antenna is formed of the tubular bobbin 31 inserted into the tubular pipe 32, the spring 33 (disposed between the bobbin and the pipe), the metal rod 34 and the + cutting portion 35.

Figure 5:
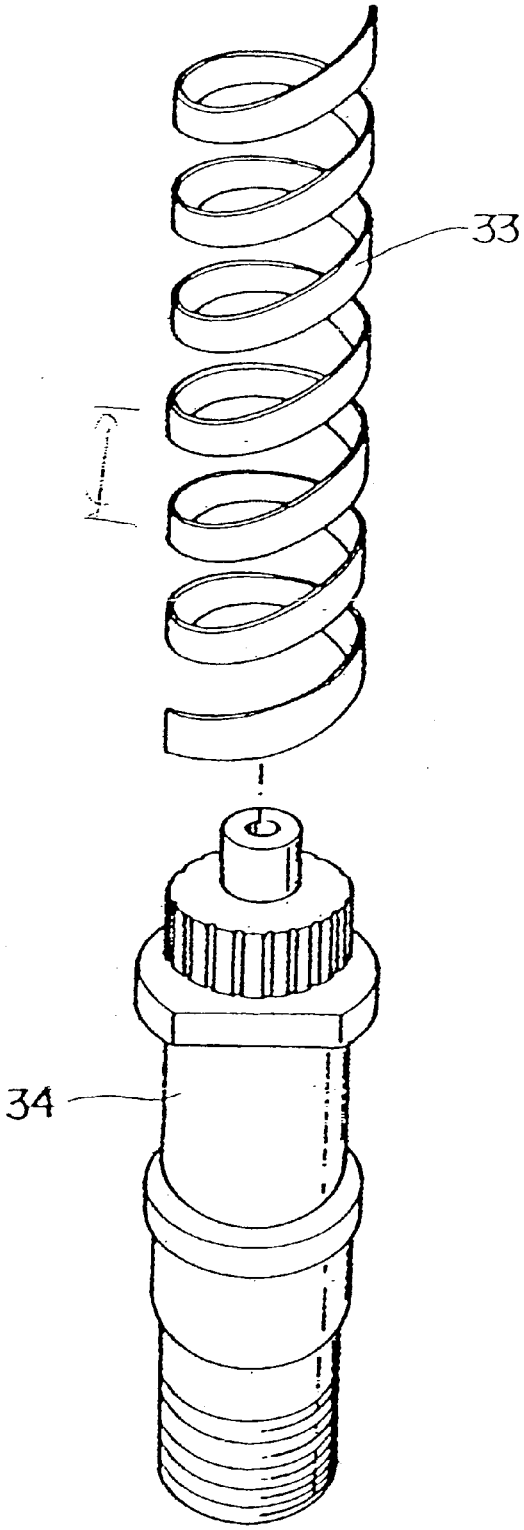
FIG. 5 is an enlarged perspective view illustrating the construction of a spring of an antenna according to the present invention.
Figure 6:
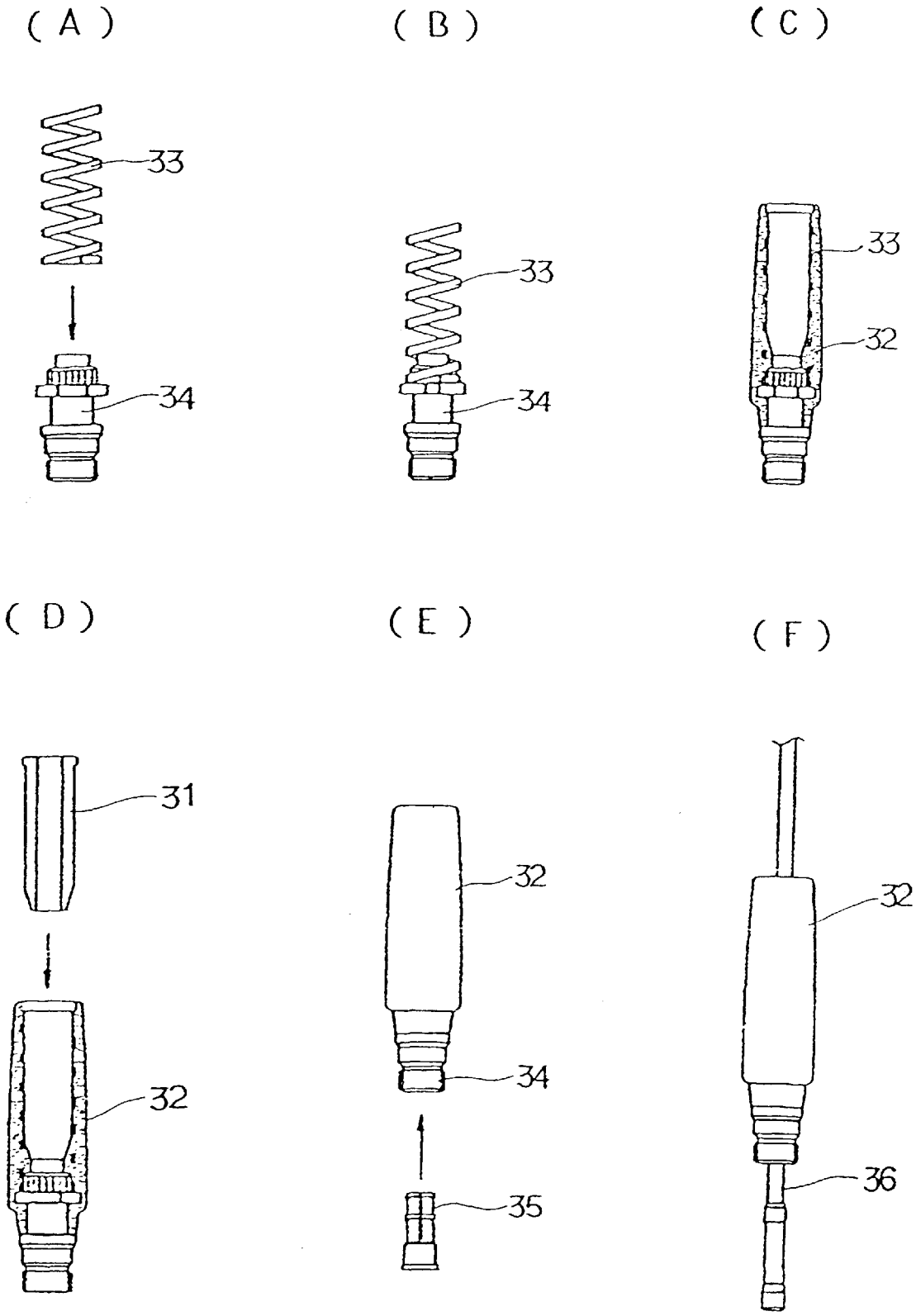
FIGS. 6A through 6F are views illustrating an assembling process of an antenna according to the present invention.

FIG. 5 is an enlarged perspective view illustrating the structure of the spring 33 fixed to the metal rod 34 of the helical antenna of the antenna according to the present invention. As shown therein, the spring 33 according to the present invention is formed by pressing a wire having a diameter of about ϕ0.7 for thereby fabricating a plate shaped wire having a certain width, and the thusly fabricated wire is wound by a certain number of turns for thereby forming the spring 33.

The operation of the present invention will be explained with reference to the accompanying drawings First, FIGS. 6A through 6F are views illustrating the assembling process of the antenna according to the present invention. As shown therein, a wire is pressed as shown in FIG. 6A for thereby forming a plate shaped wire having a certain width. The thusly formed plate shaped wire is wound by a certain number of turns for thereby fabricating a spring 33. The lower portion of the spring 33 is wound on the upper portion of the metal rod by one turn, and the spring 33 and the metal rod 34 are fixed each other as shown in FIG. 6B.

Next, the pipe 32 is insert-injected based on the spring 33 and the metal rod as shown in FIG. 6C, and the bobbin 31 is inserted from the upper portion of the pipe 32 for thereby fabricating the helical antenna portion.

The + cutting portion 35 is fixed at the lower portion of the helical antenna, and the top portion 30 and the Ni—Ti wire 36 are inserted into the intermediate hollow portion of the helical antenna as shown in FIG. 6F. A stopper 37 is fixed to the lower portion of the Ni—Ti wire 36 for thereby fabricating the antenna 20.

Figure 7:
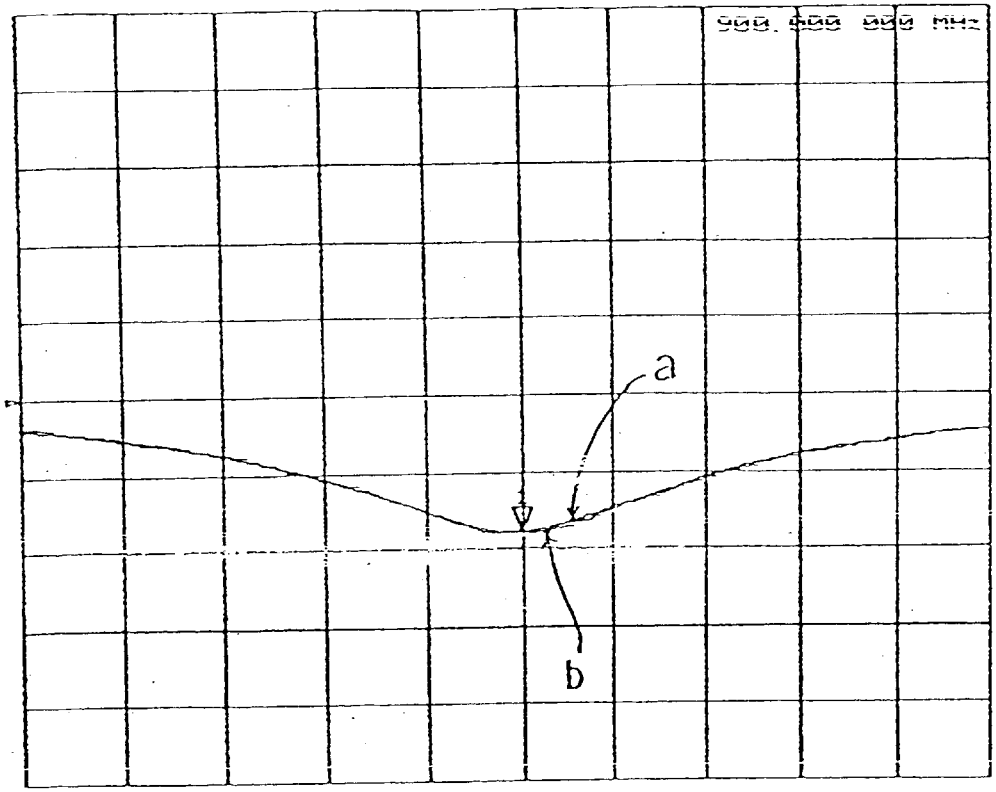
Figure 10:
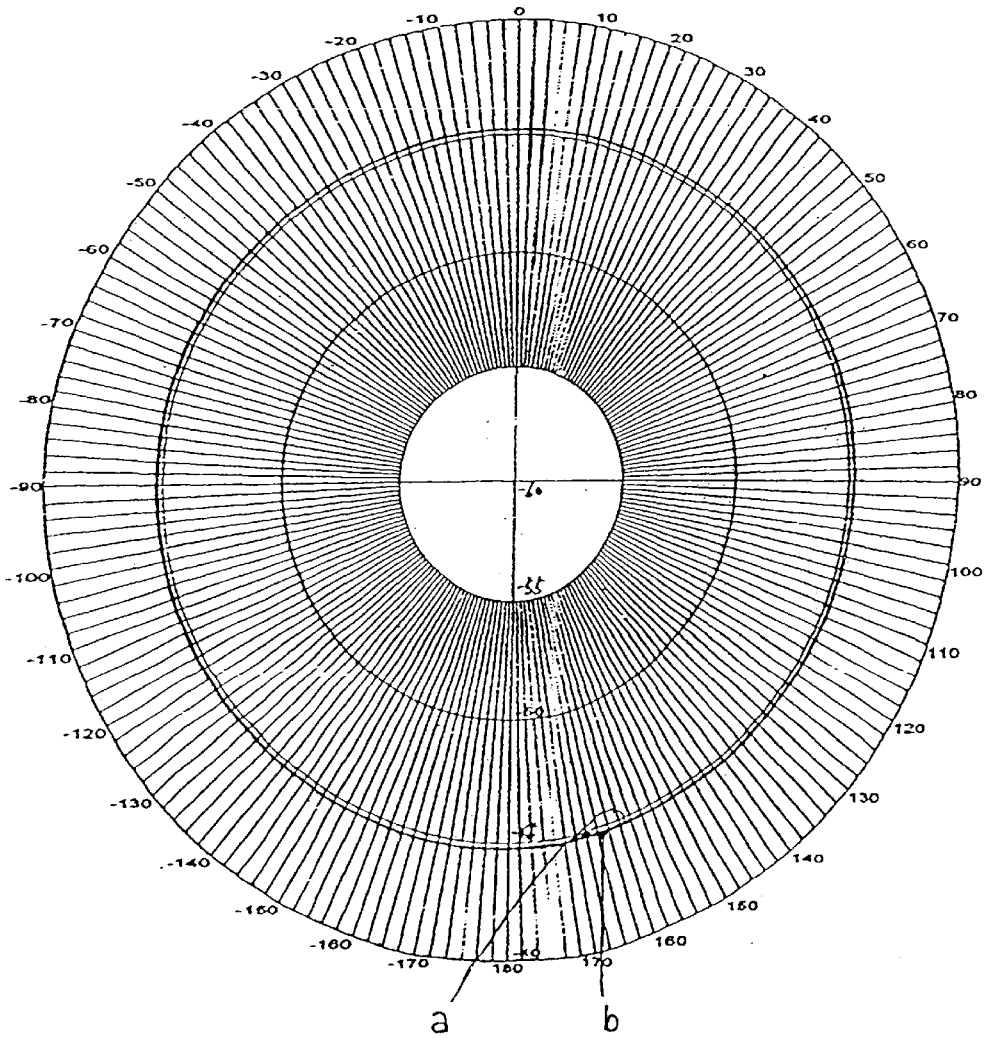

FIGS. 7 and 10 are graphs of a first test result of the characteristic of the helical antenna in such a manner that the antenna according to the present invention and the conventional antenna are not engaged to the body 10 of the mobile communication system.

Figure 8:
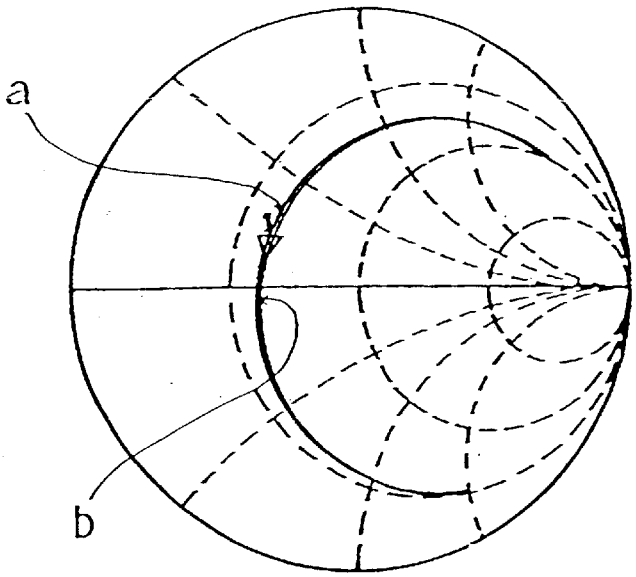
Figure 9:
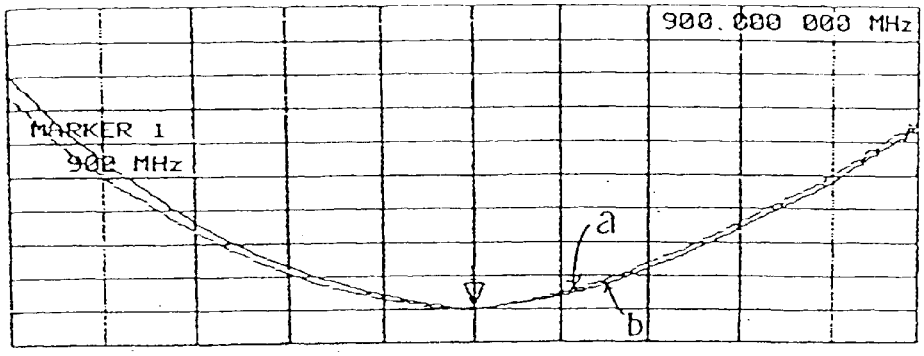

Here, FIG. 7 is a graph of a return loss characteristic. In FIG. 7, reference character "a" represents a characteristic graph of a return loss of the conventional antenna and "b" represents a characteristic graph of a return loss of the antenna according to the present invention. FIG. 8 is a smith chart graph of an impedance. In FIG. 8, reference character "a" represents a Smith chart graph of the conventional art and "b" represents a Smith chart graph of the antenna according to the present invention. FIG. 9 is a characteristic graph of the standing wave ratio. In FIG. 9, reference character "a" represents a characteristic graph of the standing wave ratio of the conventional art and "b" represents a characteristic graph of the standing wave ratio of the antenna according to the present invention. FIG. 10 is a graph of an emission pattern at a high frequency of 900 MHz obtained by measuring a network-based transmission ratio at a distance of 3 m. In FIG. 10, "a" is a graph of an emission pattern of the conventional antenna, and "b" represents a graph of an emission pattern of the antenna according to the present invention.

In FIGS. 7 through 9, the position 1 of the point ▽ represents a value measured with respect to the high frequency signal of 900 MHz.

As a result of the first measurement, the antenna according to the present invention has a lower return loss with respect to a high frequency signal of 900 MHz compared to the conventional antenna. As shown in FIG. 8, the antenna according to the present invention is similar to the reference value of 50Ω compared to the conventional art. As shown in FIG. 9, the standing wave ratio has a band width wider than the conventional antenna, and as shown in FIG. 10, the high frequency signal of 900 MHz is emitted in the whole directions.

FIGS. 11 through 15 are graphs of a second test result obtained in such a manner that the antenna according to the present invention and the conventional antenna are installed in the body 10 is not held wireless communication device, and the rod antenna is retracted, and the body 10 is not held by the user's hand at about 30 cm high from the ground.

Figure 11:
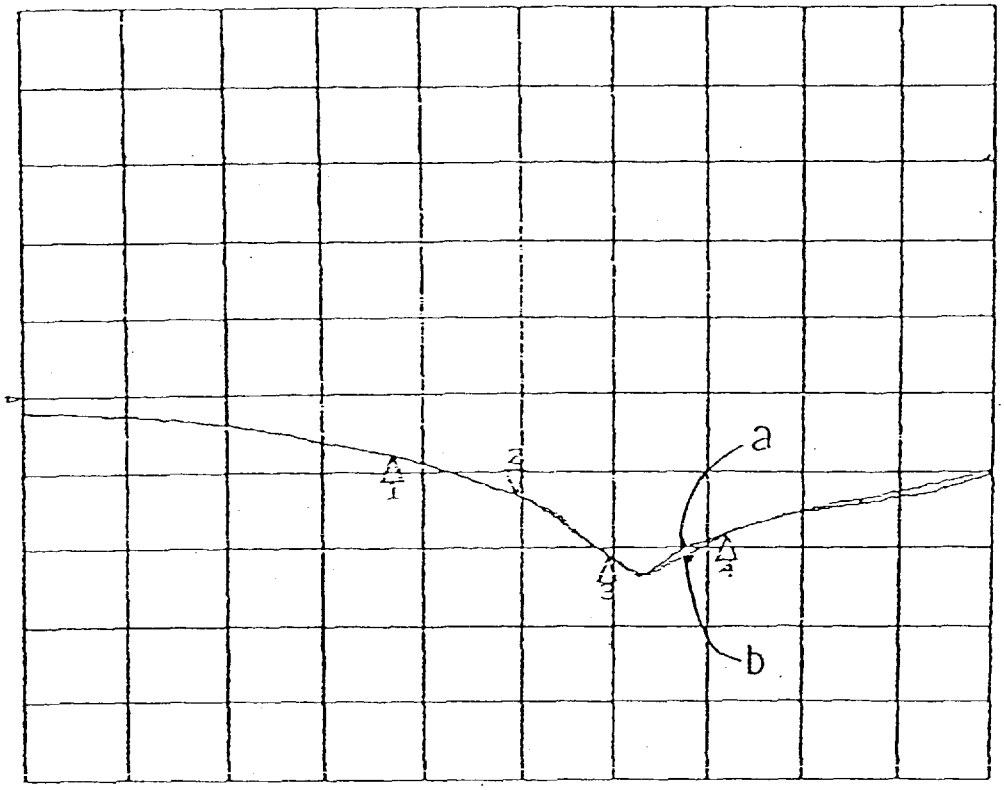
Figure 12:
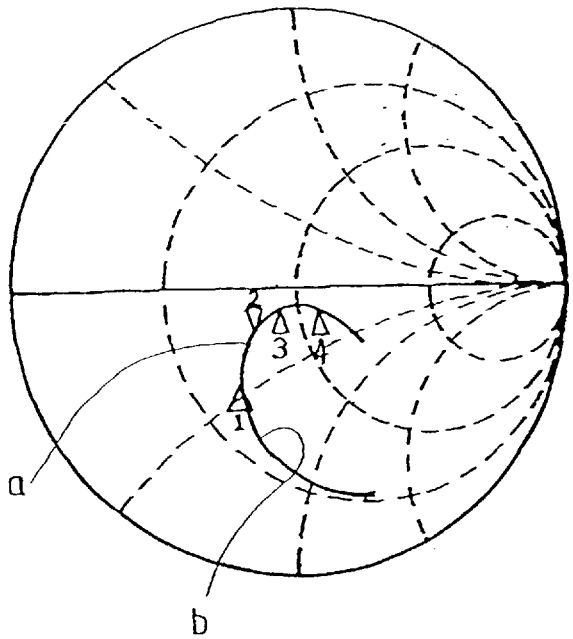
Figure 13:
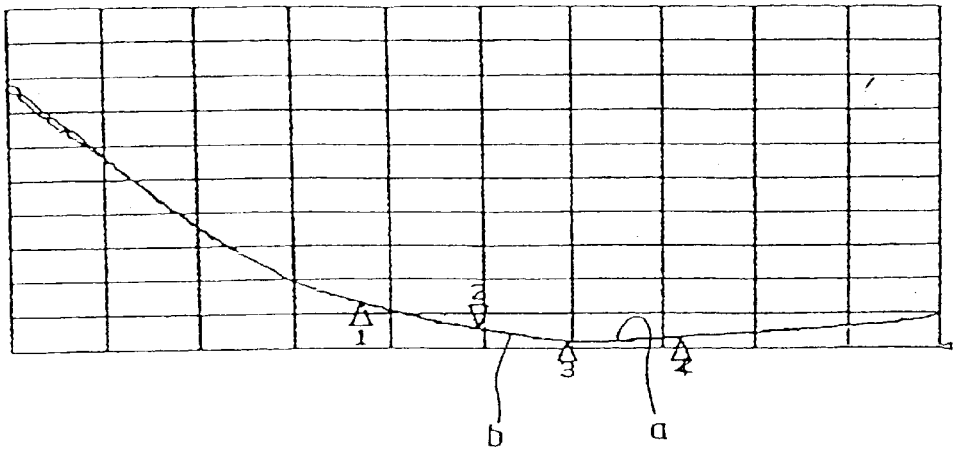

Here, FIG. 11 is a characteristic graph of the return loss. In FIG. 11, reference character "a" represents a characteristic graph of the return loss of the conventional antenna and "b" represents a characteristic graph of the return loss of the antenna according to the present invention. FIG. 12 is a Smith chart graph of the impedance. In FIG. 12, reference character "a" represents a Smith chart graph of the conventional art and "b" represents a Smith chart graph of the antenna according to the present invention. FIG. 13 is a characteristic graph of the standing wave ratio. In FIG. 13, reference character "a" represents a characteristic graph of the standing wave ratio of the conventional antenna, and "b" represents a characteristic graph of the standing wave ratio of the antenna according to the present invention.

Figure 14:
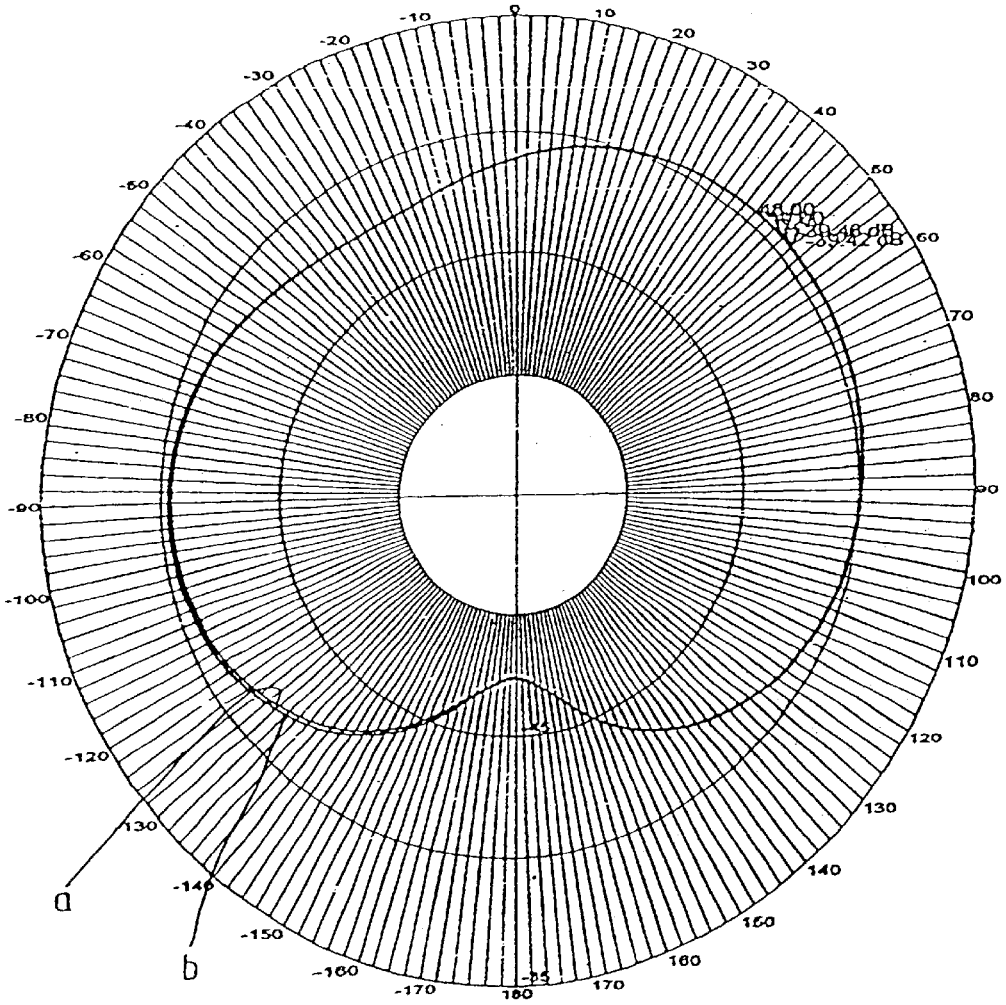

In FIGS. 11 through 13, the positions 1 through 4 of the points Δ and/or ▽ represent the test values of 824 MHz, 849 MHz, 869 MHz and 894 MHz In addition, FIG. 14 is a graph of the emission pattern of a high frequency of 836 MHz. In FIG. 14, reference character "a" represents an emission pattern graph of the conventional antenna, and "b" represents an emission pattern graph of the antenna according to the present invention.

Here, in the conventional antenna, the maximum emission value was −39.46 dB at an angle of 48.00°, and the maximum emission value was −39.42 dB at at an angle of 50.00°.

Figure 15:
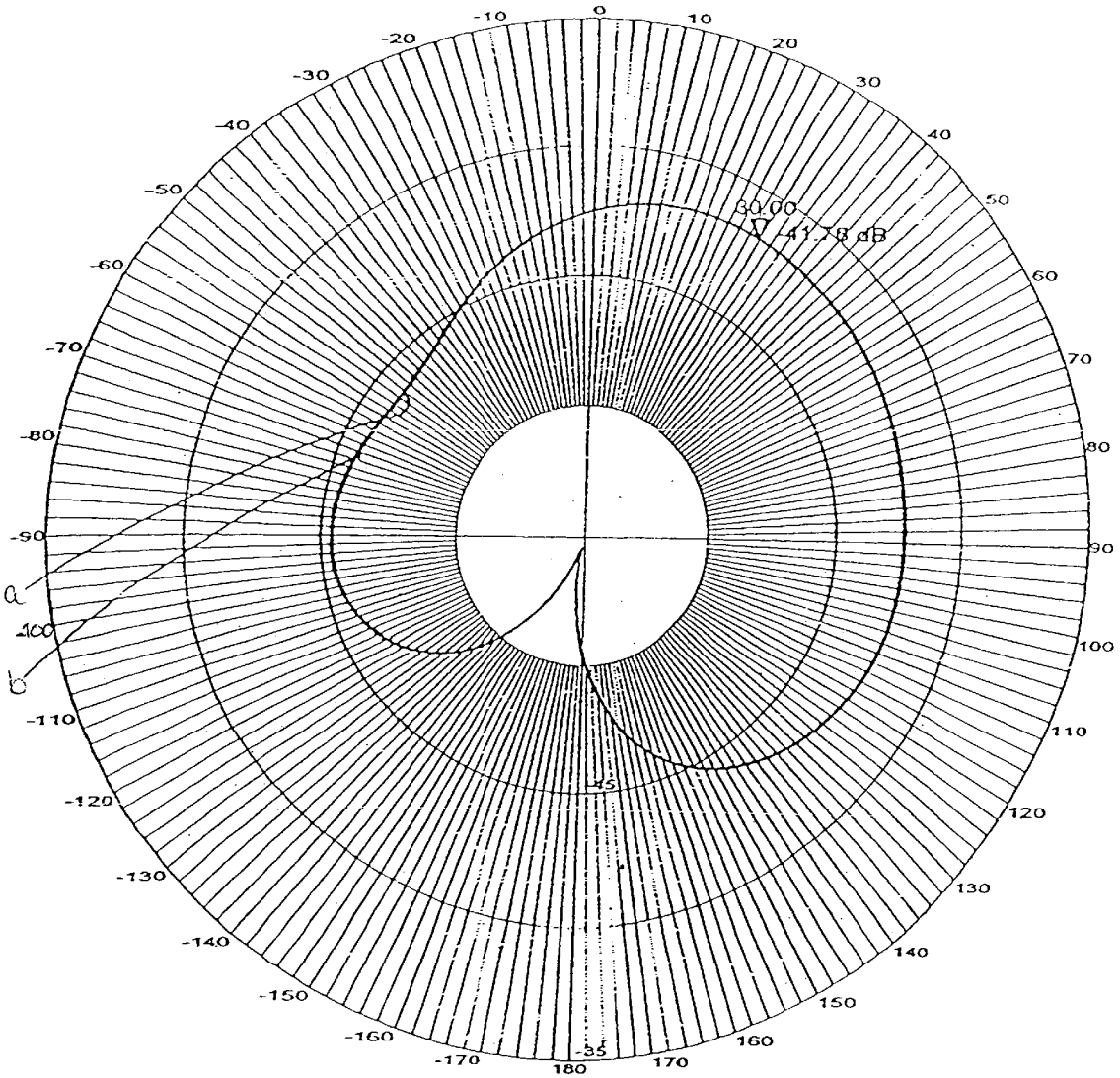

FIG. 15 is a graph of the emission pattern at a frequency of 881 MHz. In FIG. 15, reference character "a" represents an emission pattern graph of he conventional antenna, and "b" represents an emission pattern graph of the antenna according to the present invention.

Here, the antenna according to the present invention had −41.76 dB at an angle of 30.00° which is higher than the conventional art.

According to the second test result, the antenna according to the present invention has a lower return loss with respect to the high frequencies of 824 MHz, 849 MHz, 869 MHz and 894 MHz compared to the conventional art. As shown in FIG. 12, the antenna according to the present invention has an impedance similar to the reference value of 50Ω compared to the conventional antenna. As shown in FIG. 13, the standing wave ratio is low and a certain bandwidth wider than that of the conventional antenna. As shown in FIGS. 14 and 15, the high frequency signals of 836 MHz and 881 MHz are emitted in the entire directions more intensively compared to the conventional antenna.

FIGS. 16 through 20 are graphs of a third test result in such a manner that the antenna according to the present invention and the conventional antenna are installed, the rod antenna is extracted, and the body 10 is not held by the user's hand at a 30 cm high from the ground.

Figure 16:
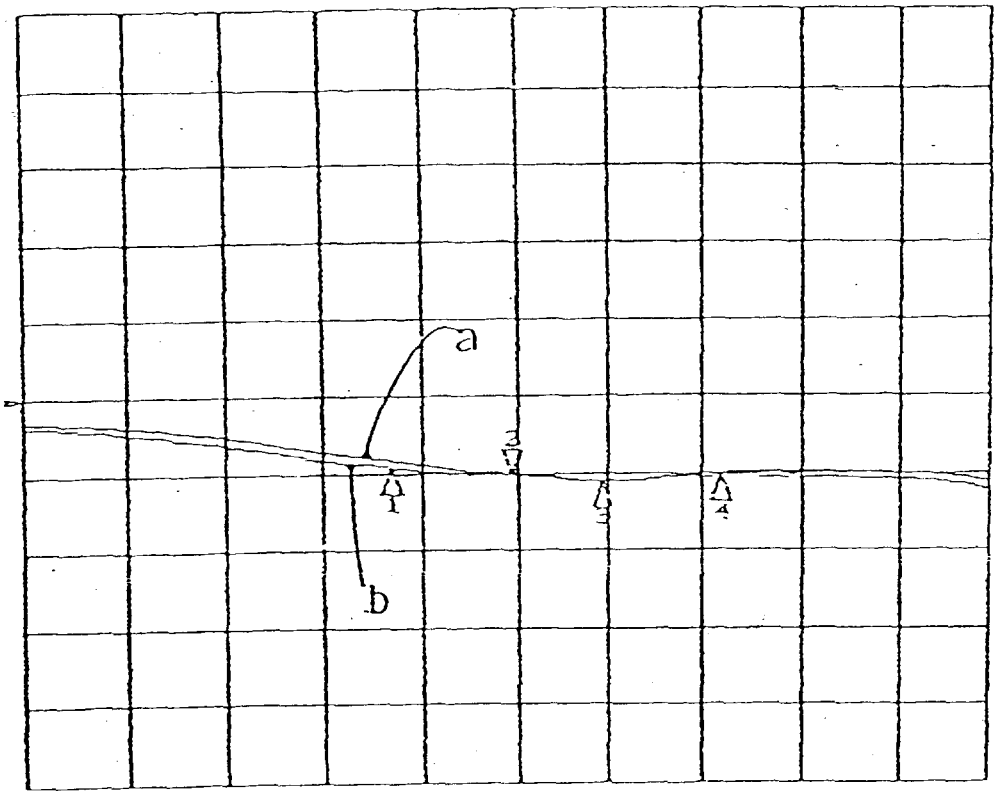
Figure 17:
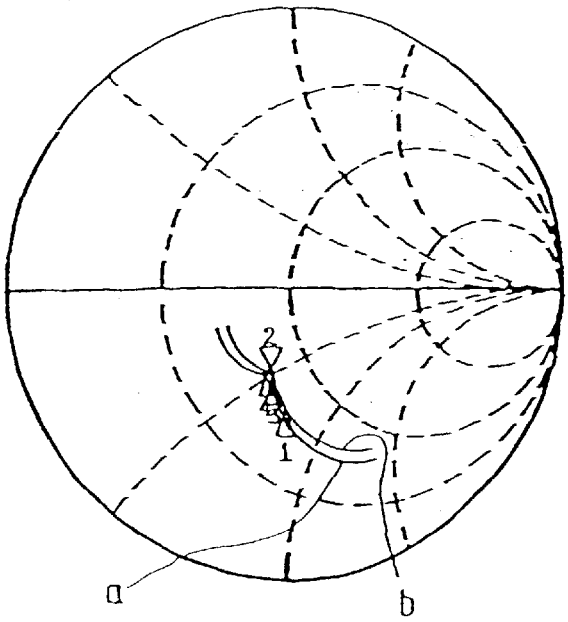
Figure 18:
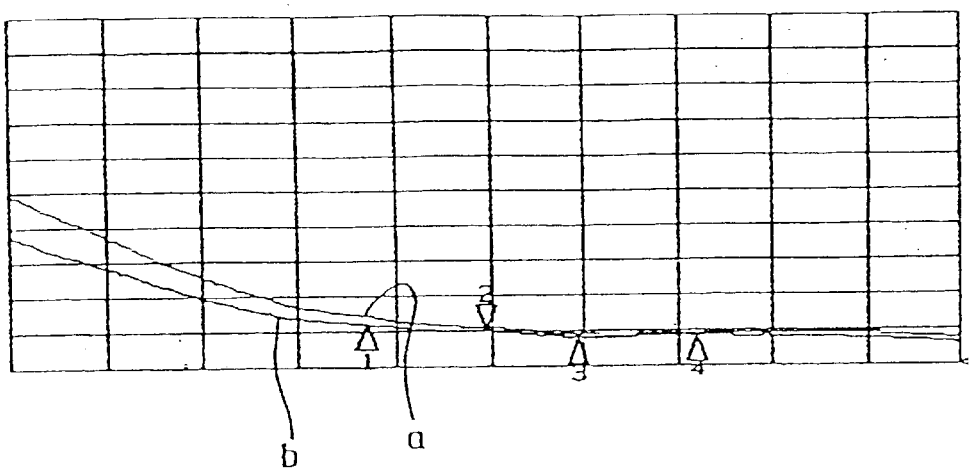

FIG. 16 is a characteristic graph of the emission loss. In FIG. 16, reference character "a" represents a characteristic graph of the return loss of the conventional antenna and "b" represents a character graph of the return loss of the antenna according to the present invention. FIG. 17 is a Smith chart graph of the impedance. In FIG. 17, reference character "a" represents a Smith chart graph of the conventional antenna and "b" represents a Smith chart graph of the antenna according to the present invention. FIG. 18 is a characteristic graph of the standing wave ratio. In FIG. 18, reference character "a" represents a characteristic graph of the standing wave ratio of the conventional antenna and "b" represents a characteristic graph of the standing wave ratio of the antenna according to the present invention.

In FIGS. 16 through 18, the positions 1 through 4 of the points Δ and/or ▽ represent the test values of 824 MHz, 849 MHz, 869 MHz and 894 MHz.

Figure 19:
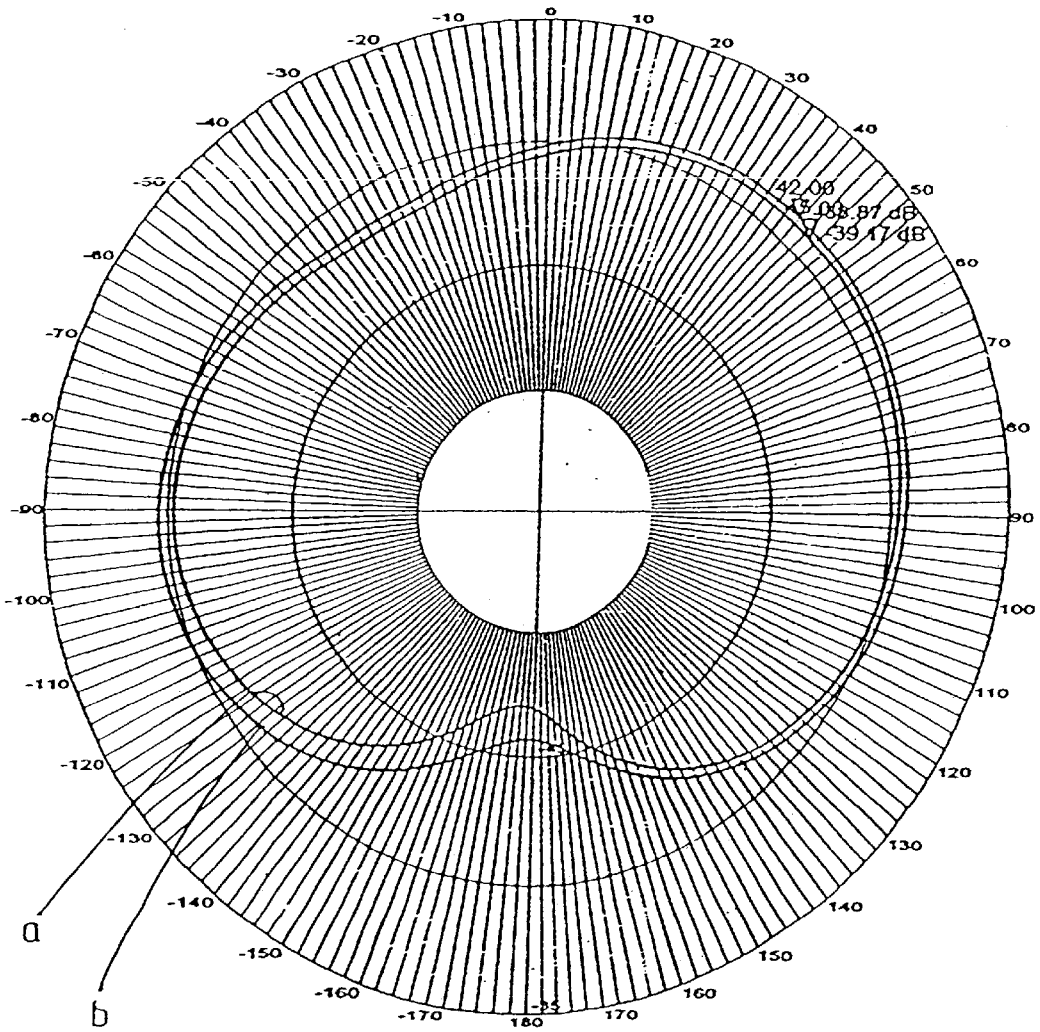

FIG. 19 is a graph of the emission pattern at a high frequency of 836 MHz. In FIG. 19, reference character "a" represents an emission pattern graph of the conventional antenna, and "b" represents an emission pattern graph of the antenna according to the present invention.

Here, in the conventional antenna, the maximum emission value was −39.17 dB at an angle of 45.00°, and in the antenna according to the present invention, the maximum emission value was −38.87 dB at an angle of 42.00°.

Figure 20:
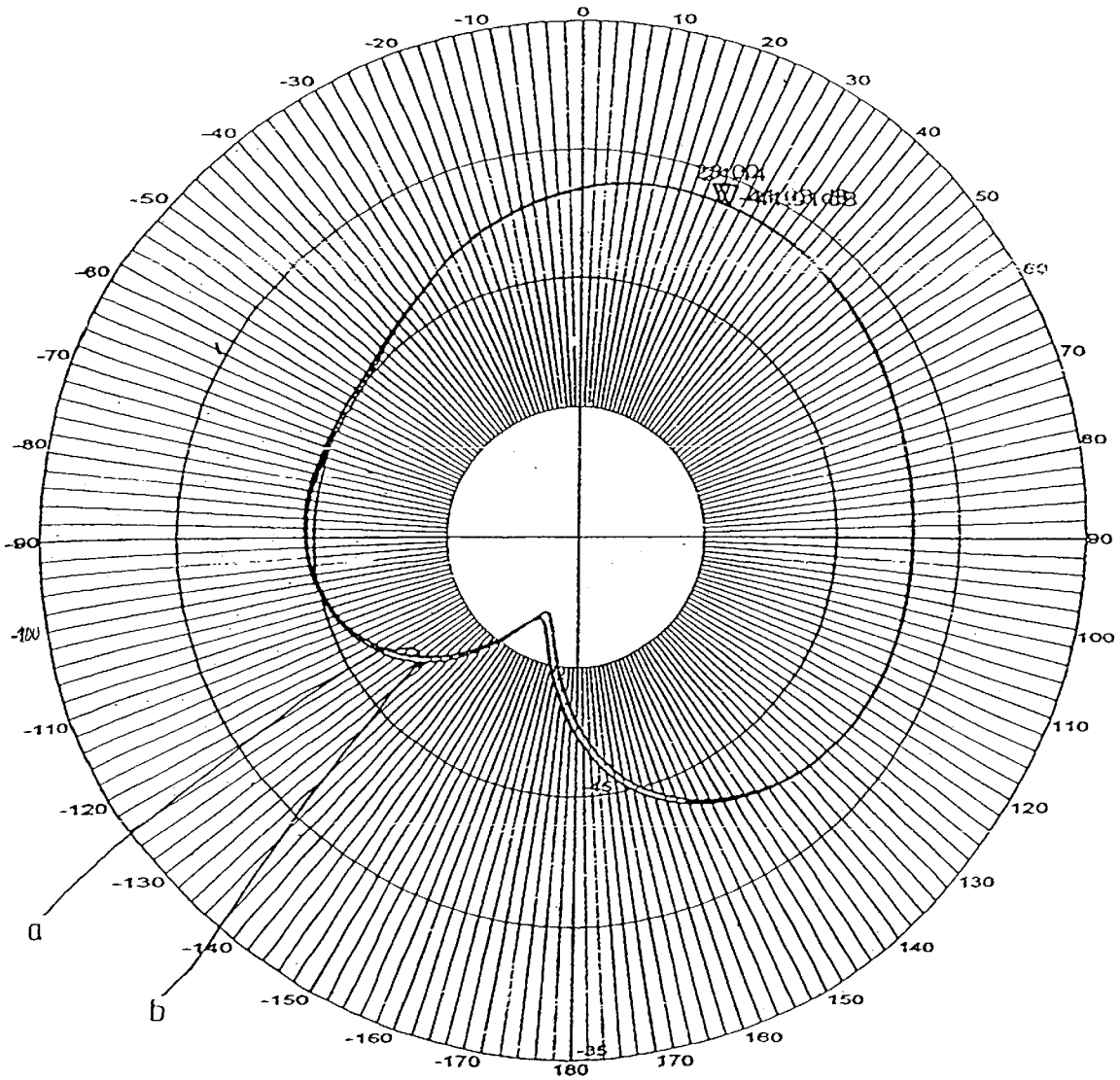

FIG. 20 is a graph of the emission pattern of a high frequency of 881 MHz. In FIG. 20, reference character "a" represents an emission pattern graph of the conventional antenna, and "b" represents an emission pattern graph of the antenna according to the present invention.

In the conventional antenna, the maximum emission value was −41.01 dB at an angle of 24.14°, and in the antenna according to the present invention, the maximum emission value was −41.03 dB at an angle of 22.00°.

According to the third test result, as shown in FIG. 16, the antenna according to the present invention has a lower return loss with respect to the high frequencies of 824 MHz, 849 MHz, 869 MHz and 894 MHz compared to the conventional antenna, and in the antenna according to the present invention, as shown in FIG. 17, the impedance is similar to the reference value of 50Ω compared to the conventional antenna. As shown in FIG. 18, the standing wave ratio is low and has a certain bandwidth compared to the conventional antenna. As shown in FIGS. 19 and 20, in the antenna according to the present invention, the high frequency signals of 836 MHz and 881 MHz are emitted in the entire directions more intensively compared to the conventional antenna.

Figure 21:
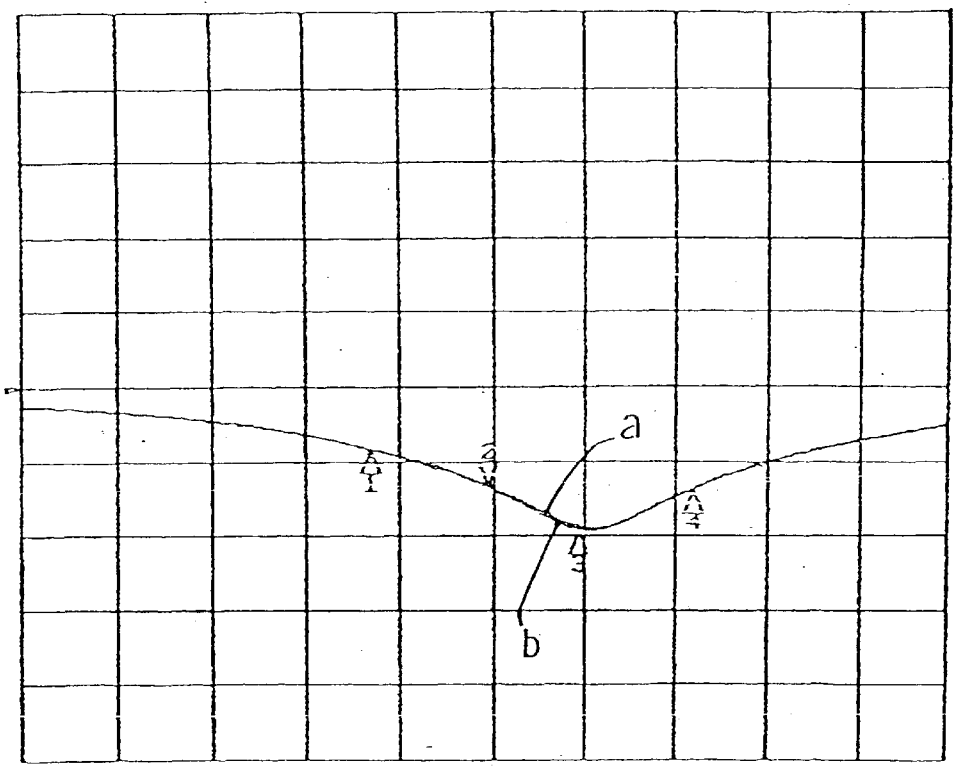
FIGS. 21 through 23 are graphs of a return loss, a Smith chart of an impedance and a standing wave ratio in such a manner that an antenna is engaged to a body of a mobile communication system, a rod antenna is inserted, and a body of a mobile communication system is moved near a right ear of a user.
Figure 22:
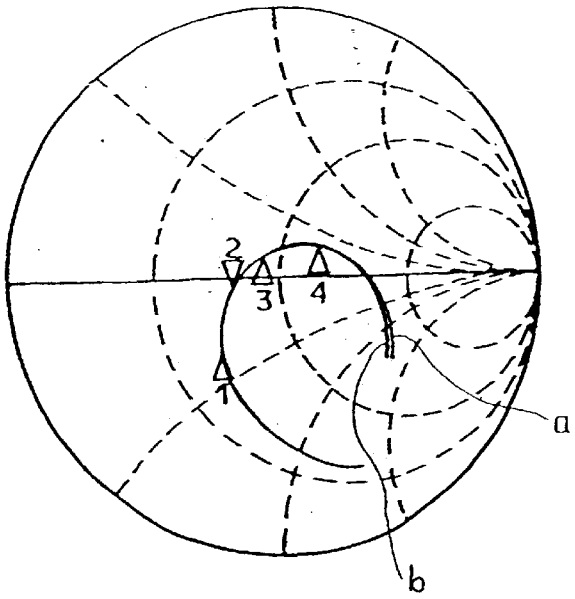
Figure 23:
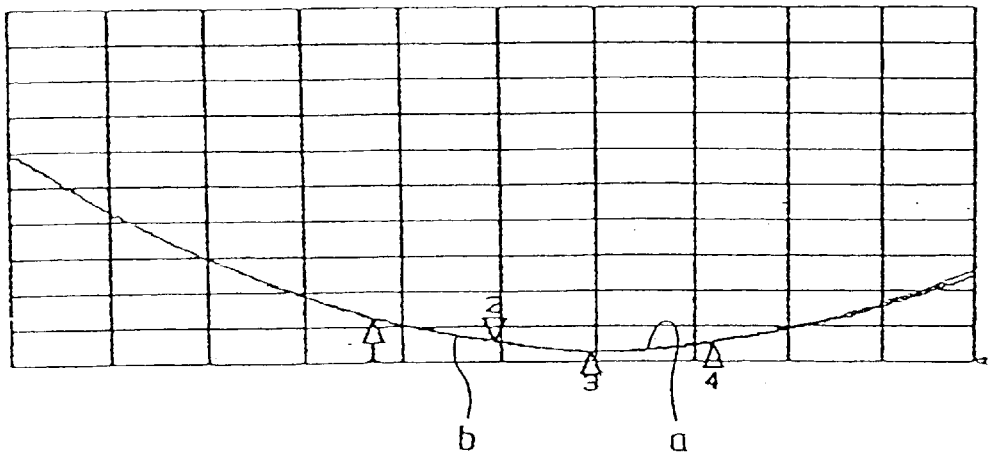
Figure 24:
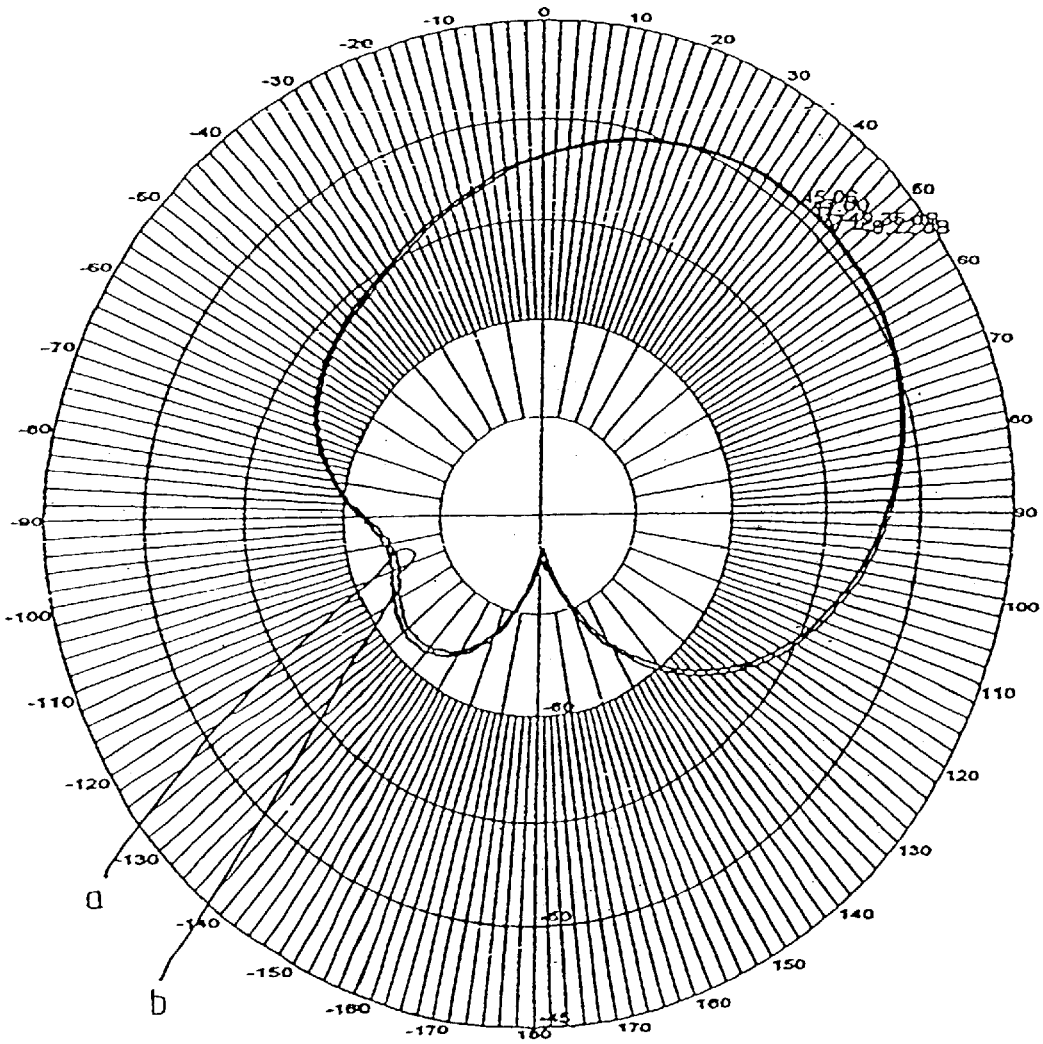
FIGS. 24 and 25 are graphs of emission patterns at frequencies of 836 MHz and 881 MHz in such a manner that an antenna is engaged to a body of a mobile communication system, a rod antenna is inserted, and the body of the mobile communication system is moved near a right ear of a test doll formed in the same shape as the head of a human.
Figure 25:
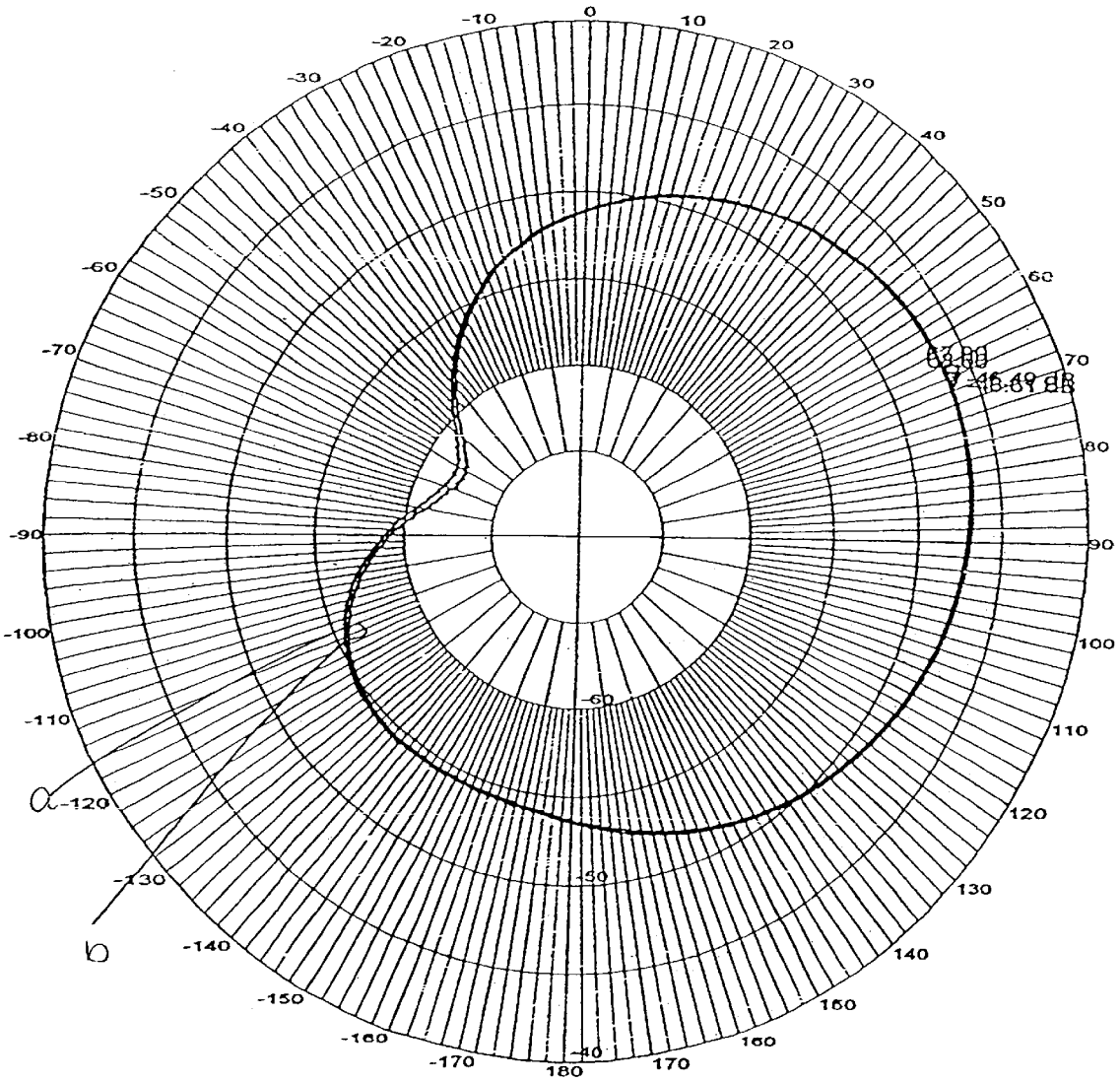

FIGS. 21 through 25 are graphs of a fourth test result. The test results of FIGS. 21 through 23 are obtained in such a manner that the antenna is engaged to the body 10 of the mobile communication system, and the rod antenna is inserted, and the body 10 of the mobile communication system is moved near the right ear of the user. In addition, the test results of FIGS. 24 and 25 are obtained in such a manner that the antenna is engaged to the body 10 of the mobile communication system, and the rod antenna is inserted, and the body 10 of the mobile communication system is moved near the right ear of the test doll formed in the same shape as a head of a human.

FIG. 21 is a characteristic graph of the return loss. In FIG. 21, reference character "a" represents a characteristic graph of the return loss of the conventional antenna, and "b" represents a characteristic graph of the return loss of the antenna according to the present invention. FIG. 22 is a Smith chart graph of the impedance. In FIG. 22, reference numeral "a" represents a Smith chart graph of the conventional antenna, and "b" represents a smith chart graph of the antenna according to the present invention. FIG. 23 is a characteristic graph of the standing wave ratio. In FIG. 23, reference character "a" represents a characteristic graph of the standing wave ratio of the conventional antenna, and "b" represents a characteristic graph of the standing wave ratio of the antenna according to the present invention.

FIG. 24 is a graph of the emission pattern of a high frequency of 836 MHz. In FIG. 24, reference character "a" represents an emission pattern graph of the conventional antenna, and "" represents an emission pattern graph of the antenna according to the present invention.

Here, in the conventional antenna, the maximum emission value was −49.35 dB at an angle of 45.06°, and in the antenna according to the present invention, the maximum emission value was −49.22 dB at an angle of 47.00°.

FIG. 25 is a graph of the emission pattern of a high frequency of 881 MHz. In FIG. 25, reference character "a" represents an emission pattern graph of the conventional antenna, and "b" represents an emission pattern graph of the antenna according to the present invention.

Here, in the conventional antenna, the maximum emission value was −46.61 dB at an angle of 68.00°. In the antenna according to the present invention, the maximum emission value was −46.49 dB at an angle of 67.00°.

Figure 26:
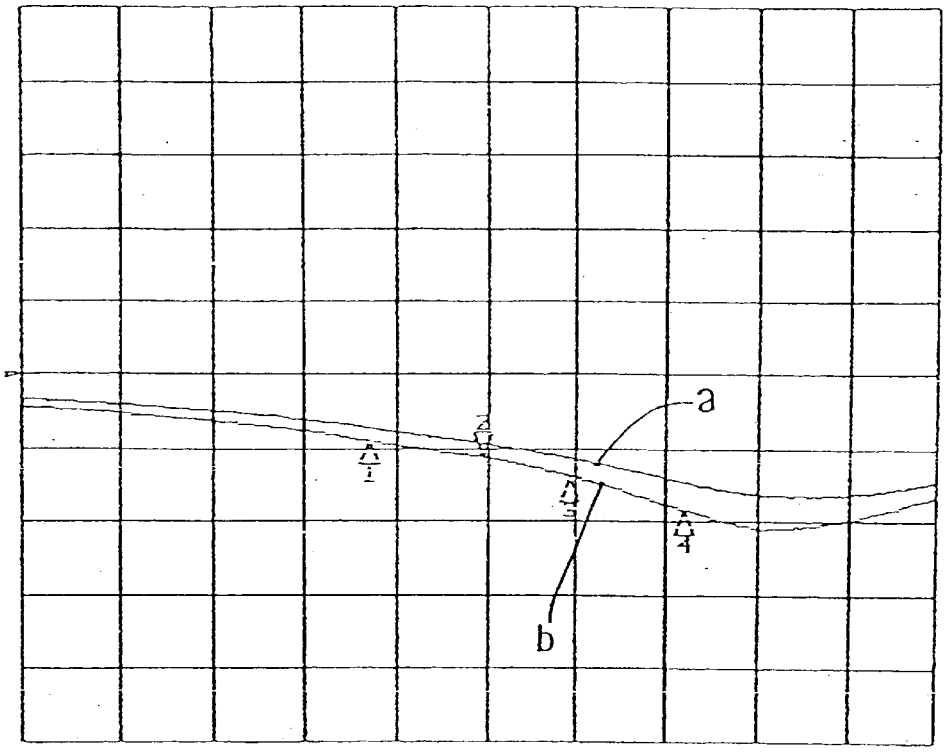
Figure 27:
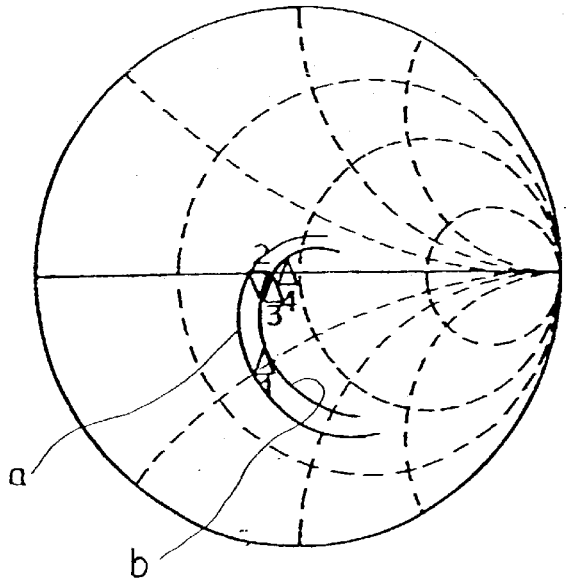
Figure 28:
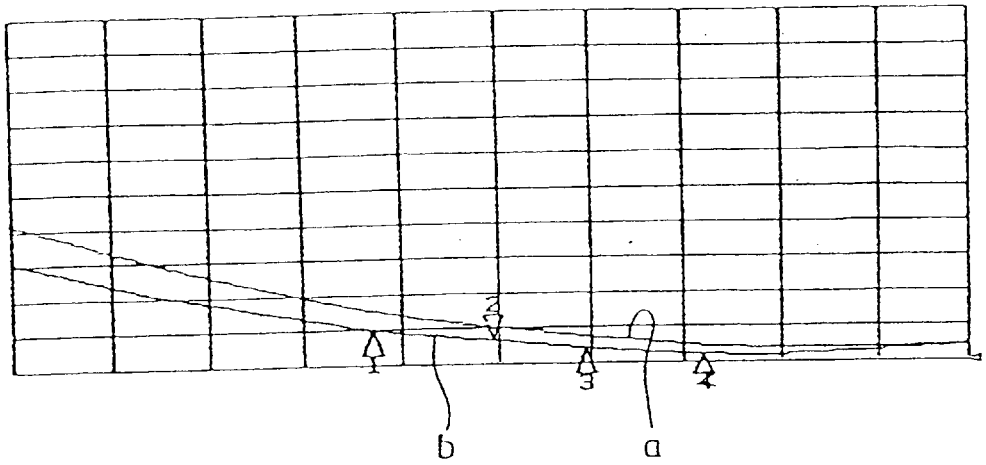
Figure 29:
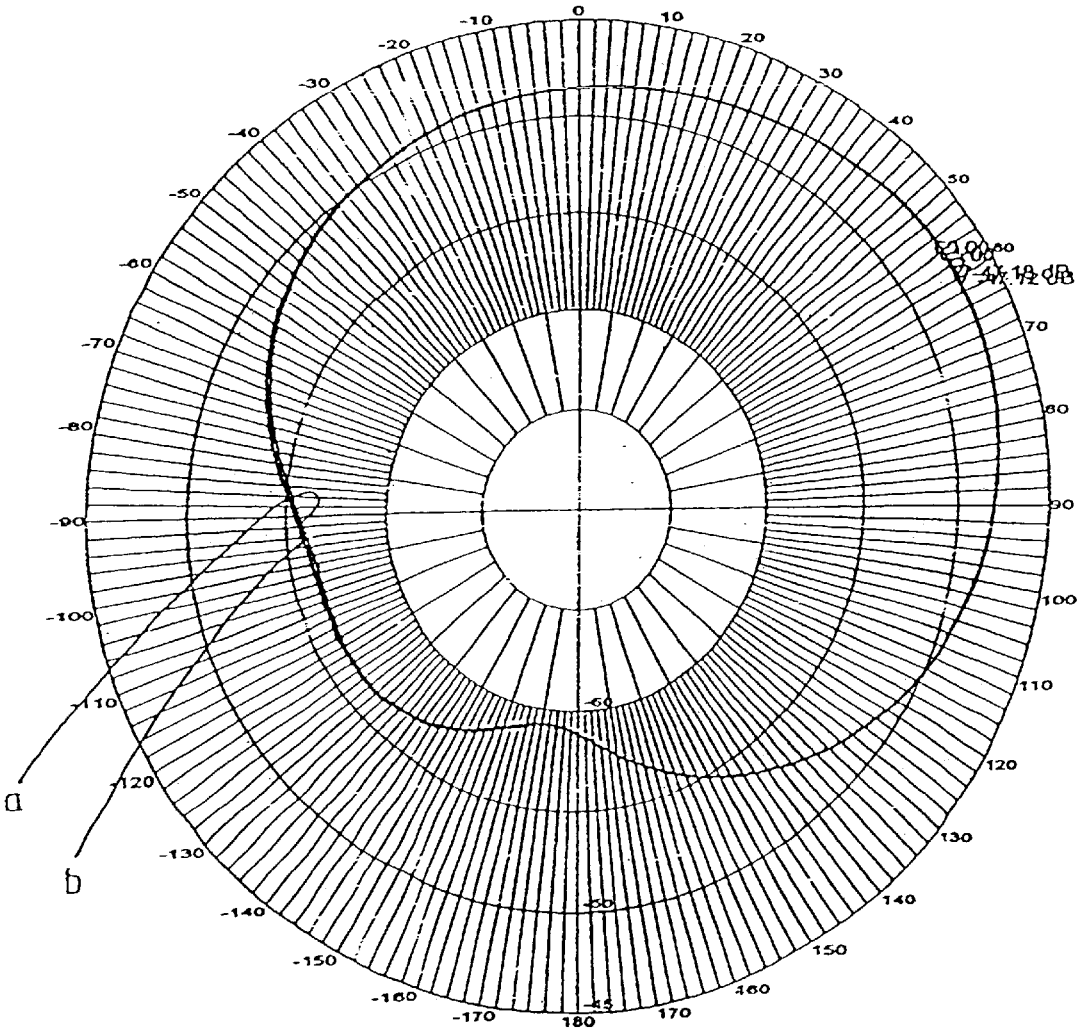
Figure 30:
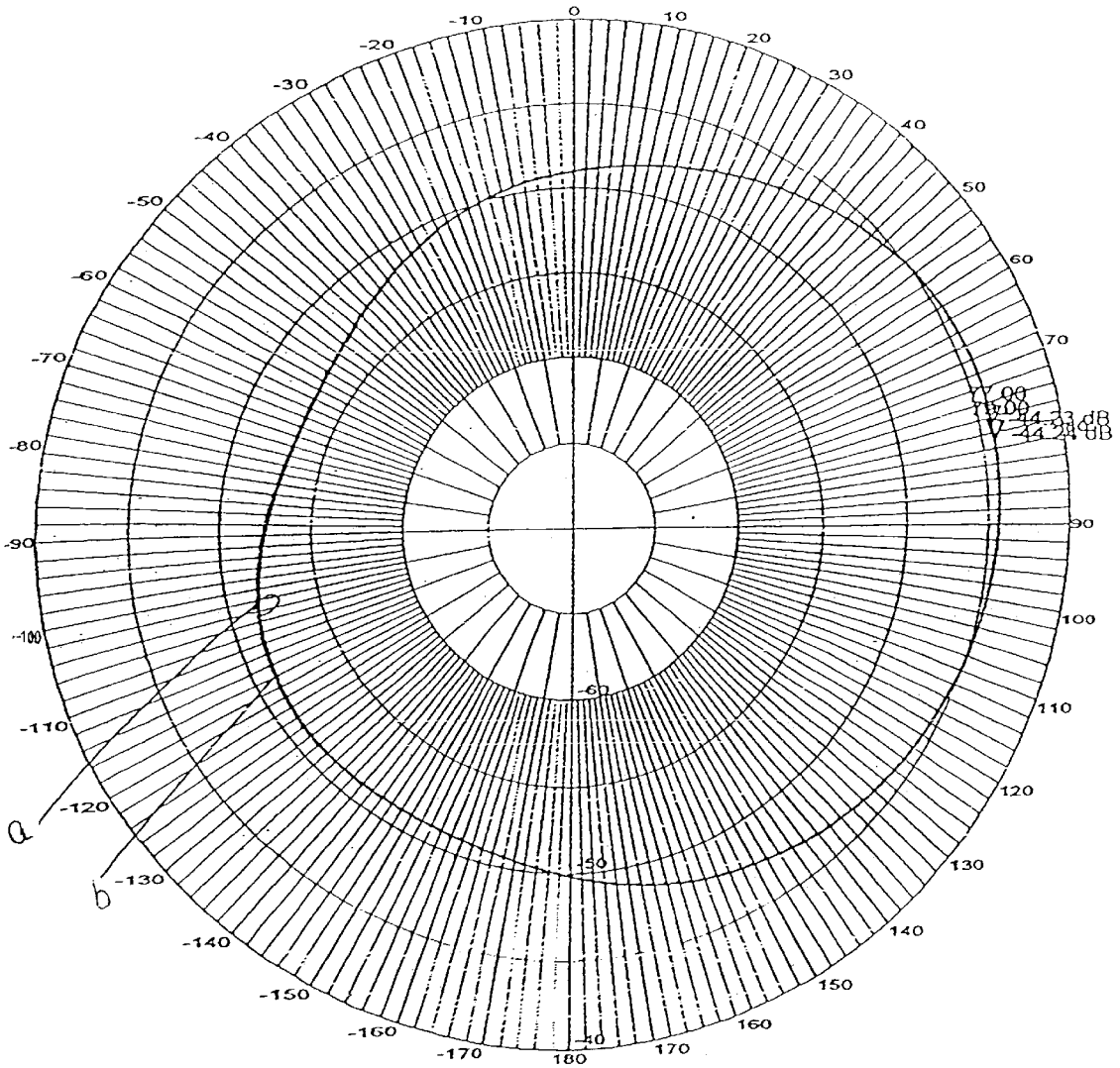

According to the fourth test result, as shown in FIG. 21, the antenna according to the present invention has a lower return loss with respect to the high frequency signals of 824 MHz, 849 MHz, 869 MHz and 894 MHz compared to the conventional antenna. A shown in FIG. 22, in the antenna according to the present invention, the impedance is similar to the reference value of 50Ω compared to the conventional antenna. As shown in FIG. 23, the standing wave ratio is low and has a certain bandwidth wider than that of the conventional antenna. As shown in FIGS. 24 and 25, the antenna according to the present invention emits high frequency signals of 836 MHz and 881 MHz in the entire directions more intensively compared to the conventional antenna FIGS. 26 through 30 are graphs of the fifth test result. The results of FIGS. 26 through 28 are obtained in such a manner that the antenna is engaged to the body 10 of the mobile communication system, and the rod antenna is extracted, and the body 10 of the mobile communication system is moved near the right ear of the user. The results of FIGS. 29 and 30 are obtained in such a manner that the antenna is engaged to the body 10 of the mobile communication system, and the rod antenna is extracted, and the body 10 of the mobile communication system is moved near the right ear of the test doll formed in the same shape as a head of a human.

Here, FIG. 26 is a characteristic graph of the return loss. In FIG. 26, reference character "a" represents a characteristic graph of the return loss of the conventional antenna and "b" represents a characteristic graph of the return loss of the antenna according to the present invention. FIG. 27 is a Smith chart graph of the impedance. In FIG. 27, reference character "a" represents a Smith chart graph of the conventional antenna, and "b" represents a Smith chart graph of the antenna according to the present invention. FIG. 28 is a characteristic graph of the standing wave ratio. In FIG. 28, reference character "a" represents a characteristic graph of the standing wave ratio of the conventional antenna, and "b" represents a characteristic graph of the standing wave ratio of the antenna according to the present invention.

In FIGS. 21 through 23, the positions 1 through 4 of the points Δ and/or ▽ represent the test values of 824 MHz, 849 MHz, 869 MHz and 894 MHz.

FIG. 29 is a graph of an emission pattern of a high frequency of 836 MHz In FIG. 19, reference character "a" represents an emission pattern graph of the conventional antenna, and "b" represents an emission pattern graph of the antenna according to the present invention.

Here, in the conventional antenna, the maximum emission value was−47.18 dB at an angle of 60.00°, and in the antenna according to the present invention, the maximum emission value was −47.12 dB at an angle of 60.00°.

FIG. 30 is a graph of the emission pattern at a high frequency of 881 MHz. In FIG. 30, reference numeral "a" represents an emission pattern graph of the conventional antenna, and "b" represents an emission pattern graph of the According to the fifth test result, as shown in FIG. 26, in the present invention, the return loss is small compared to the conventional art with respect to the high frequency signals of 824 MHz, 849 MHz, 869 MHz and 894 MHz. As shown in FIG. 27, the antenna according to the present invention has an impedance similar to the reference value of 50Ω compared to the conventional antenna, and as shown in FIG. 28, the standing wave ratio is low and has a certain bandwidth wider than that of the conventional antenna. In addition, as shown in FIGS. 29 and 30 respectively, the antenna according to the present invention has a more intensive emission with respect to the high frequencies of 836 MHz and 881 MHz in the entire directions.

As described above, in the present invention, the spring of the helical antenna is pressed for thereby fabricating a plate shaped wire having a certain width, so that the thusly fabricated wire is wound by a certain number of turns, whereby it is possible to decrease the return loss, and the bandwidth of the high frequency is increased. In the present invention, it is possible to prevent any effects of the communication quality even when there is a certain variation because the mobile communication system body is touched by a hand of a human during the communication, and the communication quality is enhanced. In addition, it is possible to simply fabricate the antenna, and the productivity is increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In an antenna for a mobile communication system antenna in which a helical antenna having a spring formed by winding a wire and a rod antenna having a wire of a certain length are integrally provided, and when the rod antenna is retracted, the helical antenna is operated, and when the rod antenna is extracted, the rod antenna and the helical antenna are connected in parallel, an antenna for a mobile communication system, comprising:

a spring of the helical antenna is formed in such a manner that a wire having a certain diameter is pressed for thereby forming a plate shaped wire having a certain width, and the plate shaped wire having a certain width is wound by a certain number of turns.

2. An antenna fabrication method of a mobile communication system, comprising the steps of:

a first step for pressing a wire having a certain diameter, forming a plate shaped wire having a certain width, winding the plate shaped wire having a certain width by a certain number of turns and forming a spring of a helical antenna;

a second step for inserting and soldering an upper end of a metal rod to a lower portion of the spring formed of a plate shaped wire and fixing the same;

a third step for insert-molding a pipe in such a manner that a certain space is formed in the center portion in the spring and metal rod fixed in the second step and inserting a bobbin of the pipe; and a fourth step for inserting a + cutting portion to a lower portion of the metal rod and inserting the rod antenna in the space portion of the center portion.

3. An antenna assembly for a mobile communication system, comprising:

a rod antenna portion including a rod antenna element of a certain length;

an inner tubular member;

an outer tubular member;

a helical antenna portion including a plate-shaped or flat helical spring element of a certain Width wound by a certain number of turns, said helical spring element being disposed between said inner tubular member and said outer tubular member; and means for connecting said helical antenna portion and said rod antenna portion to one another so that when said rod antenna element is retracted, said helical antenna portion is operable and when said rod antenna element is extended, said rod antenna element and said helical antenna portion are connected electrically in parallel.

4. The antenna assembly of claim 3 wherein said inner tubular member is in the form of a bobbin and said outer tubular member is in the form of a pipe.

5. The antenna assembly of claim 4 wherein said rod antenna portion includes a Ni—Ti wire and a stopper both connected to said rod antenna element.

6. The antenna assembly of claim 4 wherein said helical spring element is a continuous unitary element and is the only helical antenna element of said helical antenna portion.

7. The antenna assembly of claim 3 wherein said helical spring element is formed by pressing.

8. An antenna fabrication method comprising:

providing a flat or plate-shaped wire having a certain width;

winding said flat or plate-shaped wire by a certain number of turns to form a helical spring antenna element;

soldering an upper end of a metal rod to a lower portion of said spring antenna element;

after the soldering of said metal rod to said spring antenna element, insert-molding said spring antenna element inside a pipe element;

after the insert-molding of said spring antenna element inside said pipe element, inserting a tubular bobbin element inside said pipe element; and after the inserting of said bobbin element inside said pipe element, inserting a rod antenna into said bobbin element.

9. The method of claim 8 wherein the providing of flat or plate-shaped wire includes pressing a wire having a certain diameter to form said flat or plate-shaped wire.

* * * * *